United States Patent [19]

Teerman

[11] Patent Number: 4,924,821

[45] Date of Patent: May 15, 1990

[54] HYDRAULIC LASH ADJUSTER AND BRIDGE ASSEMBLY

[75] Inventor: Richard F. Teerman, Wyoming, Mich.

[73] Assignee: General Motors Corporation, Detroit, Mich.

[21] Appl. No.: 288,290

[22] Filed: Dec. 22, 1988

[51] Int. Cl.[5] ..... F01L 1/24; F01L 1/26

[52] U.S. Cl. ..... 123/90.22; 123/90.46; 123/90.55

[58] Field of Search ..... 123/90.22, 90.4, 90.46, 123/90.48, 90.52, 90.55

[56] References Cited

U.S. PATENT DOCUMENTS

| | | | |
|---|---|---|---|
| 2,380,051 | 7/1945 | Kettering | 123/90.4 |
| 3,140,698 | 7/1964 | Voorhies | 123/90.46 |
| 3,509,858 | 5/1970 | Scheibe et al. | 123/90.27 |
| 4,590,898 | 5/1986 | Buente et al. | 123/90.55 |
| 4,699,094 | 10/1987 | Stegeman | 123/90.46 |
| 4,709,668 | 12/1987 | Klug et al. | 123/90.55 |
| 4,721,076 | 1/1988 | Goppelt et al. | 123/90.55 |

FOREIGN PATENT DOCUMENTS 538952 8/1941 United Kingdom .

*Primary Examiner*—Charles J. Myhre
*Assistant Examiner*—Weilun Lo
*Attorney, Agent, or Firm*—Robert J. Outland

[57] ABSTRACT

An engine valve bridge assembly, or the like, contains an improved lash adjuster assembly including a follower body, such as in a known lash adjuster hydraulic element assembly, in an improved holder that axially separates the mounting portion from the body-carrying bore to avoid distortion of the bore from mounting of the holder. Numerous primary and alternative features are disclosed.

15 Claims, 3 Drawing Sheets

HYDRAULIC LASH ADJUSTER AND BRIDGE ASSEMBLY

TECHNICAL FIELD

This invention relates to hydraulic lash adjusters and to mounting assemblies incorporating such lash adjusters. In specific embodiments, the invention also relates to engine valve bridge assemblies including dual hydraulic lash adjusters carried in recesses of the bridge for actuating dual valves of an associated engine.

BACKGROUND

It is known in the art relating to internal combustion engines, such as diesel engines, to actuate two adjacent valves of an engine cylinder by a cam actuated rocker arm acting through a valve bridge. The valve bridge may incorporate two hydraulic lash adjuster assemblies which are received in recesses near opposite ends of the valve bridge to engage and directly act upon the ends of the valve stems. Examples of prior proposed arrangements are shown in U.S. Pat. Nos. 2,380,051 Kettering issued July 10, 1945 and 3,140,698 Voorhies issued July 14, 1964.

In these prior arrangements, the lash adjuster assemblies are retained in pressure oil receiving recesses, either by press fitting or by screw thread retention, both of which are shown by U.S. Pat. No. 2,380,051. The traditional press fit arrangement of U.S. Pat. No. 2,380,051 provides an outer shell 42 (holder) held in a recess 37, 39 and receiving a reciprocable piston 44 (body) that directly engages an associated valve. In U.S. Pat. No. 3,140,698, a plunger 27 is added inside the reciprocable body (which also acts as a cylinder 24) and the holder is in the form of a bushing 21.

In both arrangements, sufficient clearance must be provided between the holder and the reciprocable body to avoid binding of the body due to distortion of the holder from its press fitting into the valve bridge recess. In operation, this distortion and the necessary clearance can result in an excessive loss of pressure oil from the valve bridge between the holder and body. While the oil loss would be reduced in the arrangement of U.S. Pat. No. 3,140,698 by retaining the higher pressures inside the reciprocable body 21, the effect may still be significant. Similar effects could result from distortion of an alternative threaded holder screwed tightly into a valve bridge recess, as has also been previously proposed.

SUMMARY OF THE INVENTION

The present invention provides an improved hydraulic lash adjuster assembly which reduces or avoids distortion of the holder bore in which the body is reciprocable and thereby reduces or eliminates the need for extra clearance on this account. Loss of oil through the clearance may be minimized thereby without risking binding of the body in the holder. The assembly is primarily intended for use in valve bridges of relatively large locomotive type medium duty diesel engines, although the invention is not limited to such use.

The invention further provides an improved assembly utilizing a special holder having a recess for receiving a known hydraulic element assembly (HEA). The HEA is of a relatively small size conventionally used in smaller automotive engines and of a type comprising a body and plunger urged apart by a spring and defining a check valved pressure chamber.

The holder recess includes a bore for reciprocably supporting the body, the bore being axially spaced from an adjacent mounting portion of the holder which may be subject to distortion upon mounting in a valve bridge or other member by press fitting, screw threading or the like. Contact between the body and the mounting portion of the holder may be avoided by relieving either the bore or the body wherever they are axially coextensive. Distortion of the bore is further reduced by maintaining it axially within an enlarged flanged portion of the holder which is not easily distorted by mounting distortion of the adjacent reduced thickness mounting portion.

The invention additionally provides the improved combination of a valve bridge with dual hydraulic lash adjusters according to the invention and arranged to minimize bore distortion in the lash adjuster holder.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
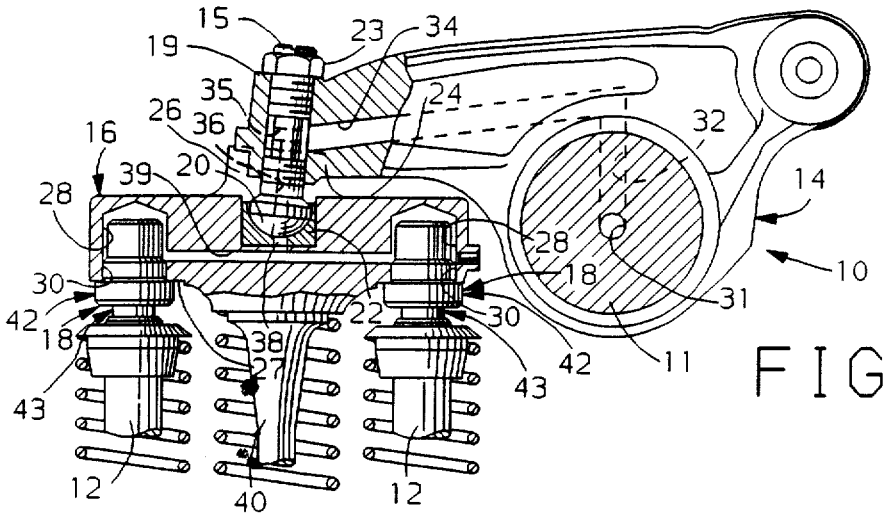
FIG. 1 is a side view, partially in cross section, illustrating portions of the valve gear for a diesel engine including a valve bridge having dual hydraulic lash adjuster assemblies in accordance with the invention.

Referring now to the drawings in detail, numeral 10 generally indicates a portion of the valve gear 10 for an internal combustion engine. The illustrated arrangement is for an engine of the medium speed diesel type commonly used in diesel locomotives; however, features of the invention are capable of use in many other applications.

The valve gear 10 includes a rocker shaft 11 mounted upon an engine cylinder head, not shown, having a plurality of exhaust valves 12, two of which are shown. The rocker shaft 11 carries a rocker arm 14 having an adjustable screw actuator 15 that engages a valve bridge 16 according to the invention. The valve bridge carries dual hydraulic lash adjuster assemblies 18 according to the invention which engage the stem ends of the two associated exhaust valves 12 for actuating them in a conventional manner when the rocker arm 11 is actuated by a camshaft, not shown.

The screw actuator 15 is threadably mounted at one end 19 of the rocker arm 14 and is adjustable for setting the position or "lash" of the valve gear 10. A ball end 20 at the lower end engages a hardened cup 22 in the valve bridge 16 and a lock nut 23 at the upper end fixes the adjusted position of the actuator 15.

The valve bridge 16 carries the cup 22 centrally of its upper surface 24 between a pair of guidewalls 26 receiving the end 19 of the rocker arm 14. Spaced oppositely from the cup 22 and opening through the lower surface 27 of the valve bridge 16, at opposite ends thereof, are a pair of recesses 28. Each of the recesses is formed as a downwardly opening blind bore having adjacent the open end thereof a cylindrical internal surface 30 for engaging and retaining an associated one of the hydraulic lash adjuster assemblies 18 mounted in the respective recess.

Hydraulic fluid for actuating the lash adjusters 18 is preferably engine lubricating oil supplied to the recesses 28 from an externally fed gallery 31 in the rocker shaft 11 through connecting passages 32, 34, 35, 36, 38, 39 in the rocker arm 14, screw actuator 15 and valve bridge 16. A guide stem 40 on the valve bridge cooperates with means, not shown, to guide the reciprocating valve actuating motion of the valve bridge on the cylinder head.

Each of the dual hydraulic lash adjuster assemblies 18 includes a holder 42 and a body 43 reciprocably carried in the holder. In the preferred embodiments illustrated, the body 43 is one element of a known hydraulic element assembly (HEA) which further includes a plunger 44, plunger spring 46, ball check 47, cage 48 and optional ball spring 50.

The body 43 is cup shaped with a closed lower end 51 having a flat end surface 52 that engages the stem end of an associated exhaust valve for actuating it. The plunger 44, reciprocably mounted within the body, is hollow with an orificed inner wall 45 that defines with the body an internal hydraulic pressure chamber controlled by the ball check 47.

Operation of the HEA is similar to that described for constructions shown, for example, in U.S. Pat. No. 3,509,858 Scheibe et al, FIG. 3, and U.S. Pat. No. 4,699,094 Stegeman, FIG. 3.

The holder 42 is of generally cylindrical shape having axially adjacent portions including a reduced outer diameter inner end portion 54, an intermediate outer diameter central mounting portion 55 and an enlarged outer diameter support portion 56 defining a thickened flange of relatively stiff construction.

Internally, the flanged support portion is provided with an axial bore 58 that acts as a cylinder in which the HEA body 43 reciprocates to take up lash in the valve train and maintain engagement with the valve stem. The bore 58 forms part of an open ended internal recess 59 extending axially within the axially spaced support and mounting portions for receiving the HEA. The recess 59 has a flat end 60 that is engaged by the open upper end of the plunger 44. A central passage 62 in the inner end portion 54 admits oil to the HEA to provide hydraulic lash adjusting action.

The portion of the recess 59 within the mounting portion has a radial relief 63 extending outward of the bore diameter to avoid any contact of the holder mounting portion with portions of the body and an attached retaining ring 64 which extend therein. This relief 63 in the mounting portion limits the axial extent of the guide bore 58 to the thickened support portion and thereby avoids binding of the body 43 in the bore 58 due to distortion of the mounting portion upon installation of the lash adjuster assembly in its valve bridge recess 28.

Preferably, the outer diameter of the mounting portion 55 is has a small undercut 66 where it adjoins the flanged support portion 56. In addition to providing for easier machining of the outer diameter, this undercut may further reduce the effects of any mounting distortion of the mounting portion 55 on the bore 58 within the axially adjacent and thicker flanged support portion 56.

Figure 2:
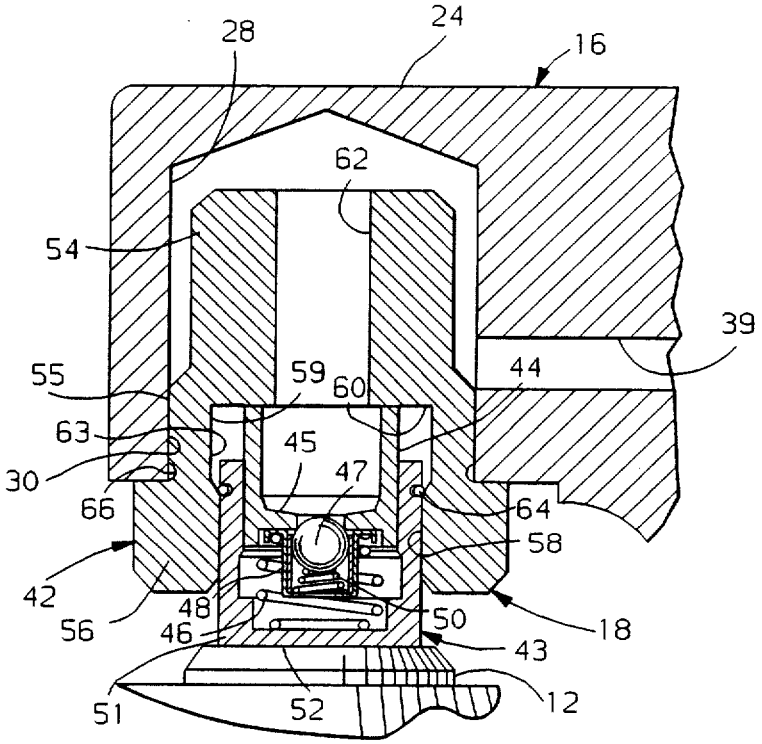
FIG. 2 is a cross-sectional view of one of the lash adjuster assemblies of FIG. 1 as mounted by press-fitting in the valve bridge.

In the embodiment of FIGS. 1 and 2, the holder mounting portions 55 are machined on their outer diameters for press fitting of the lash adjuster assemblies 18 into the internal surfaces 30 for retaining the assemblies 18 in their valve bridge recesses 28. The distortion of the mounting portions 55 due to the press fit does not significantly distort the bore 58 in view of the relief 63 and resulting axial spacing of the bore 58 from the mounting portion 55, the undercut 66 further minimizing the axial connection between the adjacent portions.

Figure 3:
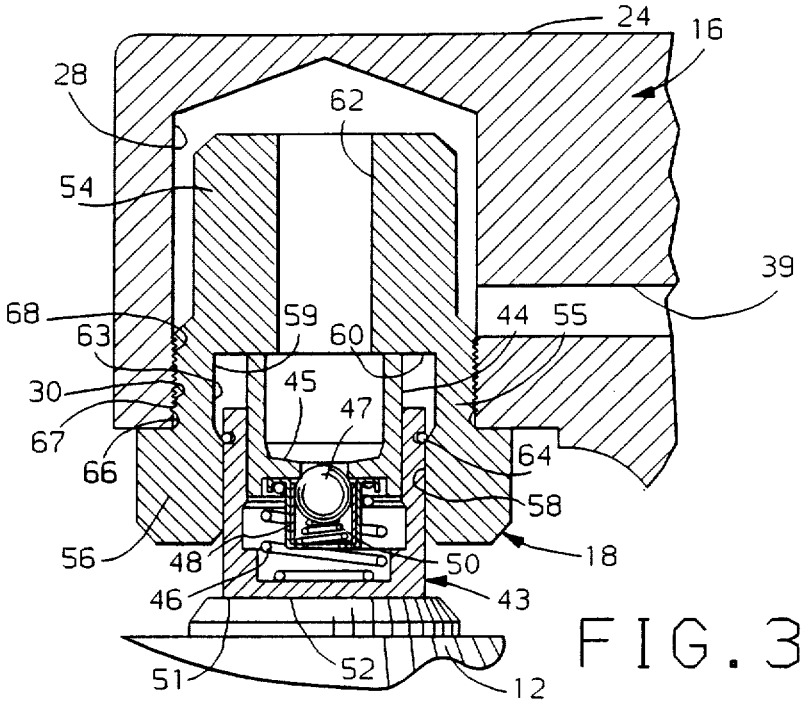
FIG. 3 is a view similar to FIG. 2 showing an alternative screw thread mounting of the lash adjuster assembly.

The embodiment of FIG. 3 is similar to that of FIG. 2 but differs in that the outer diameter of the mounting portion 55 has threads 67 that engage mating threads 68 formed on the internal surface 30 of the associated valve bridge recess 28 to retain the lash adjuster in the recess 28.

Figure 4:
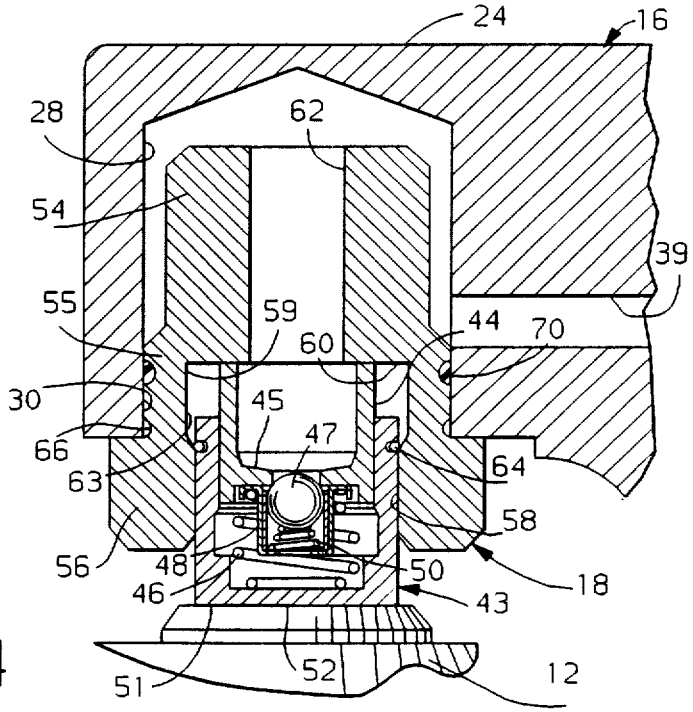
FIG. 4 is a view similar to FIG. 2 showing an alternative mounting using an O-ring seal for retention.

In FIG. 4, the mounting portion 55 and internal surface 30 are arranged with cylindrical surfaces for slip fit assembly. However, an 0-ring seal 70 mounted on the outer diameter of the mounting portion 55 is compressed against the surface 30 upon installation. This provides means for retention of the lash adjuster assembly 18 in its valve bridge recess 28 as well as a seal against oil leakage through the joint.

Figure 5:
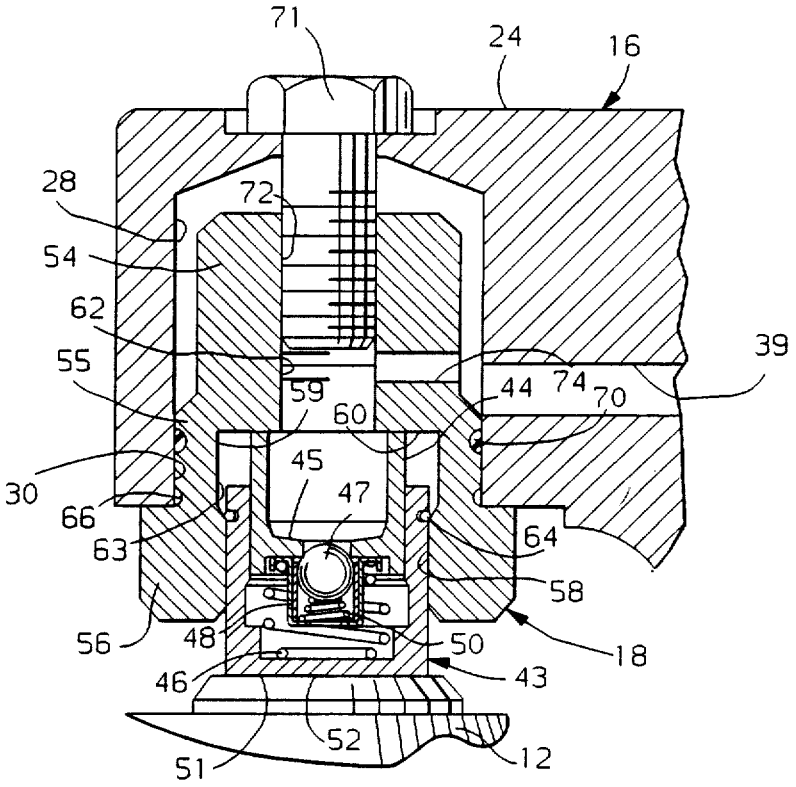
FIG. 5 is a view similar to FIG. 2 showing still another mounting arrangement using a threaded screw for retention.

FIG. 5 illustrates means similar to FIG. 4 but additionally includes a retaining screw 71 carried by the top of the valve bridge and threadably engaging threads 72 in the passage 62 to more surely retain the lash adjuster assembly 18 in its recess 28. A lateral oil passage 74 is provided in the holder 42 to admit oil to the passage 62 below the screw 71.

In all of the illustrated embodiments, the body-carrying bore 58 is contained within the relatively stiff flanged support portion 56 of the holder 42 and is axially spaced from the distortable mounting portion 55 which is internally relieved to avoid contact with the reciprocating body 43. Thus, any small distortion of the mounting portion 55, due to fitting of the holder 42 in its recess, temperature changes in operation, or the like, is prevented from causing significant distortion of the bore 58 and interfering with the necessary movement of the body 43 within the bore 58.

It should be understood that, as used in the description and the following claims, the term bore means an internal cylinder which may be formed by any suitable process and finish machined in any desired manner including, without limitation, boring, grinding, honing, lapping and/or other processes which may be used to obtain the desired fit and finish.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

We claim:

1. A hydraulic lash adjuster assembly comprising a holder for mounting in a recess of a valve actuating member as part of a mounting assembly, said holder having support and mounting portions, said support portion having a bore receiving an externally cylindrical reciprocable body member, and said mounting portion having generally cylindrical external means engagable with said valve actuating member for maintaining said holder in said valve actuating member, said mounting portion and the bore in said support portion being axially spaced from one another, a recess in said mounting portion extending axially from said bore for receiving portions of said body member, and means defining a clearance between the interior of said recess and the exterior of said body member to avoid any contact between said body member and the mounting portion.

2. A hydraulic lash adjuster assembly as in claim 1 wherein said support portion is made stiffer than said mounting portion to minimize distortion of the bore upon limited distortion of the mounting portion.

3. A holder for mounting a lash adjuster assembly in a valve actuating member, said holder including support and mounting portions, said support portion having a bore for receiving an externally cylindrical reciprocable body member of such lash adjuster assembly and being relatively stiff to minimize distortion of the bore, and said mounting portion having generally cylindrical external means engagable with such valve actuating member for maintaining said holder in said valve actuating member, said support and mounting portions being axially spaced to avoid substantial distortion of the bore in said support portion as a result of limited distortion of the mounting portion, a recess in said mounting portion extending axially from said bore, and an outward relief of said mounting portion recess outward of the bore to avoid any contact between such body member of a lash adjuster assembly in said bore and said mounting portion.

4. A hydraulic lash adjuster assembly comprising a holder for mounting in a recess of a valve actuating member as part of a mounting assembly, said holder having axially centered support, mounting and end portions, said support portion having an axial bore and being relatively stiff to minimize distortion of the bore, a hydraulic element assembly (HEA) in said bore, said HEA including a cup shaped body member and a hollow plunger within the body member and defining therewith a check-valved internal hydraulic pressure chamber, said body member being axially reciprocable within said bore and on said plunger, said mounting portion having an internal recess extending axially from said bore for receiving said plunger and portions of said reciprocable body member, and generally cylindrical external means around said internal recess, and engagable with the recess of such valve actuating member for mounting said lash adjuster assembly in such valve actuating member, said end portion including an annular seat at the end of said internal recess opposite said bore, said plunger normally engaging said annular seat, said holder including means for conducting hydraulic fluid to the interior of said plunger for delivery to said pressure chamber, and said support and mounting portions being axially spaced to avoid substantial distortion of the bore in said support portion as a result of limited distortion of the mounting portion.

5. A hydraulic lash adjuster assembly as in claim 4 and further comprising means defining a clearance between the interior of said mounting portion recess and the exterior of said body member to avoid any contact between said body member and said distortable mounting portion.

6. A hydraulic lash adjuster assembly as in claim 5 wherein said clearance is formed by an annular relief of the mounting portion recess adjacent to said bore.

7. A hydraulic lash adjuster assembly as in claim 4 wherein said support portion comprises a thickened flange at one end of said holder.

8. A hydraulic lash adjuster assembly as in claim 4 wherein said end portion has an axial opening comprising said hydraulic fluid conducting means.

9. A hydraulic lash adjuster assembly as in claim 4 wherein said external means of the mounting portion comprises an annular outer surface sized for press fitting into a cooperating internal surface of such valve actuating member recess.

10. A hydraulic lash adjuster assembly as in claim 4 wherein said external means of the mounting portion comprises an external threaded portion engagable with cooperating internal threads in such valve actuating member recess.

11. A hydraulic lash adjuster assembly as in claim 4 wherein said external means of the mounting portion comprises means retaining an annular compressible seal ring sized for compressive sealing engagement with a cooperating internal surface of such valve actuating member recess.

12. A hydraulic lash adjuster assembly as in claim 11 wherein said seal ring is also sized for compressive retaining engagement with such internal surface of the valve actuating member recess.

13. A hydraulic lash adjuster assembly as in claim 12 wherein said seal ring comprises the sole means for retaining said lash adjuster assembly in said valve actuating member recess.

14. A valve actuating assembly including in combination an actuating member having a recess including internal mounting means and a hydraulic lash adjuster assembly mounted in said recess, said lash adjuster assembly comprising a holder for mounting in said recess and having axially centered support, mounting and end portions, said support portion having an axial bore and being relatively stiff to minimize distortion of the bore, a hydraulic element assembly in said bore, said hydraulic element assembly including a cup shaped body member and a hollow plunger within the body member and defining therewith a check-valved internal hydraulic pressure chamber, said body member being axially reciprocable within said bore and on said plunger, said mounting portion having an internal recess extending axially from said bore for receiving said plunger and portions of said reciprocable body member, and generally cylindrical external means around said internal recess and engagable with said internal mounting means of the recess of said valve actuating member for mounting said lash adjuster assembly in said valve actuating member, said end portion including an annular seat at the end of said internal recess opposite said bore, said plunger normally engaging said annular seat, said holder including means for conducting hydraulic fluid to the interior of said plunger for delivery to said pressure chamber, and said support and mounting portions being axially spaced to avoid substantial distortion of the bore in said support portion as a result of limited distortion of the mounting portion due to mounting in said internal mounting means of the actuating member.

15. A valve bridge assembly including in combination a bridge member and a pair of hydraulic lash adjuster assemblies, said bridge member having a pair of recesses opening through one side thereof on parallel axes spaced at opposite ends of the bridge member and including internal mounting means, and means for delivering hydraulic fluid to each of the recessess, one of said lash adjuster assemblies being mounted in each said recesses and each said lash adjuster assembly comprising a holder mounted in its respective recess and having axially centered support, mounting and end portions, said support portion having an axial bore and being relatively stiff to minimize distortion of the bore, a hydraulic element assembly in said bore, said hydraulic element assembly including a cup shaped body member and a hollow plunger within the body member and defining therewith a check-valved internal hydraulic pressure chamber, said body member being axially reciprocable within said bore and on said plunger, said mounting portion having an internal recess extending axially from said bore for receiving said plunger and portions of said reciprocable body member, and generally cylindrical external means around said internal recess and engaging said internal mounting means of the respective recess of said bridge member for mounting said lash adjuster assembly in said bridge member, said end portion including an annular seat at the end of said internal recess opposite said bore, said plunger normally engaging said annular seat, said holder including means for conducting hydraulic fluid to the interior of said plunger for delivery to said pressure chamber, and said support and mounting portions being axially spaced to avoid substantial distortion of the bore in said support portion as a result of limited distortion in assembly of the mounting portion.

* * * * *

UNITED STATES PATENT AND TRADEMARK OFFICE

CERTIFICATE OF CORRECTION

PATENT NO. : 4,924,821
DATED : May 15, 1990
INVENTOR(S) : Richard F. Teerman

It is certified that error appears in the above-identified patent and that said Letters Patent is hereby corrected as shown below:

On the title page, item [19] after "Teerman" add -- et al.--.

Abstract page, column 1, line 5, Inventor designation "[75]" should read -- [75] Inventors: Richard F. Teerman, Wyoming, Mich.; Chi Cheng, Clarendon Hills, Ill. --.

Column 5, line 4, "said" should read -- such --.

Signed and Sealed this

Tenth Day of September, 1991

*Attest:*

*Attesting Officer*

HARRY F. MANBECK, JR.

*Commissioner of Patents and Trademarks*